US010675669B2

(12) United States Patent
Stoppiglia

(10) Patent No.: US 10,675,669 B2
(45) Date of Patent: Jun. 9, 2020

(54) METHOD FOR PRODUCING A BEVERAGE CAN, A BOTTLE-CAN OR AN AEROSOL CAN FROM ALUMINIUM ALLOY

(71) Applicant: CONSTELLIUM NEUF-BRISACH, Biesheim (FR)

(72) Inventor: Hervé Stoppiglia, Meylan (FR)

(73) Assignee: CONSTELLIUM NEUF-BRISACH, Biesheim (FR)

( * ) Notice: Subject to any disclaimer, the term of this patent is extended or adjusted under 35 U.S.C. 154(b) by 270 days.

(21) Appl. No.: 15/112,455

(22) PCT Filed: Jan. 15, 2015

(86) PCT No.: PCT/FR2015/000017
§ 371 (c)(1),
(2) Date: Jul. 19, 2016

(87) PCT Pub. No.: WO2015/107284
PCT Pub. Date: Jul. 23, 2015

(65) Prior Publication Data

US 2016/0332208 A1 Nov. 17, 2016

(30) Foreign Application Priority Data

Jan. 20, 2014 (FR) ..... 14 00104

(51) Int. Cl.
*B21D 51/26* (2006.01)
*B21D 22/20* (2006.01)
*B21D 28/06* (2006.01)

(52) U.S. Cl.
CPC ..... *B21D 51/26* (2013.01); *B21D 22/20* (2013.01); *B21D 28/06* (2013.01)

(58) Field of Classification Search
CPC ..... B21D 22/20–30; B21D 24/00–16; B21D 28/06
See application file for complete search history.

(56) References Cited

U.S. PATENT DOCUMENTS 4,005,665 A 2/1977 Nishihara et al.
4,603,571 A * 8/1986 Wessels ..... B21D 22/26 72/347
4,711,611 A * 12/1987 Bachmann ..... B21D 51/26 413/69
5,630,337 A * 5/1997 Werth ..... B21D 22/28 72/349

(Continued)

FOREIGN PATENT DOCUMENTS

EP 0740971 A1 11/1996
EP 1870481 A1 12/2007

(Continued)

OTHER PUBLICATIONS

Dick et al., "Convolute CutEdge Design for an Earless Cup in Cup Drawing" AIP Publishing. (2005) p. 1.

(Continued)

*Primary Examiner* — Gregory D Swiatocha
(74) *Attorney, Agent, or Firm* — McBee Moore & Vanik IP, LLC

(57) ABSTRACT

A method for manufacturing a beverage can, a bottle or a spray can made of aluminium alloy, by means of deep drawing-ironing followed by necking and/or bending, from a non-circular blank.

11 Claims, 4 Drawing Sheets

(56) References Cited

U.S. PATENT DOCUMENTS

| | | | | |
|---|---|---|---|---|
| 5,749,258 | A | 5/1998 | Werth et al. | |
| 2004/0007579 | A1* | 1/2004 | Gillest | B65D 7/04 220/660 |
| 2015/0246384 | A1* | 9/2015 | Ikeda | B21D 22/22 72/347 |

FOREIGN PATENT DOCUMENTS

| | | | | |
|---|---|---|---|---|
| EP | 2172284 | A1 * | 4/2010 | B21D 22/28 |
| EP | 2172284 | A1 | 4/2010 | |
| JP | H11309517 | A | 11/1999 | |
| JP | 2003082429 | A | 3/2003 | |
| WO | 0115829 | A1 | 3/2001 | |

OTHER PUBLICATIONS

International Search Report dated Jan. 6, 2015 in counterpart Application No. PCT/FR2015/000017.

* cited by examiner

METHOD FOR PRODUCING A BEVERAGE CAN, A BOTTLE-CAN OR AN AEROSOL CAN FROM ALUMINIUM ALLOY

CROSS REFERENCE TO RELATED APPLICATIONS

This application is a § 371 National Stage Application of PCT/FR2015/000017, filed Jan. 15, 2015, which claims priority to FR 1400104, filed Jan. 20, 2014.

BACKGROUND

Field of the Invention

The invention relates to the field of beverage cans made of aluminium alloy, also known to those skilled in the art as "cans", or beverage cans, but also bottle-cans and spray cans, manufactured by deep drawing-ironing, i.e. according to a method particularly including these two basic steps.

The invention relates more particularly to an optimised deep drawing method for this type of application and particularly having the advantage of avoiding the so-called "earing" phenomenon, well known to those skilled in the art, with the risk of breakage involved during subsequent ironing operations.

Description of Related Art

Aluminium alloys are increasingly used in the manufacture of cans, also known as beverage cans, but also bottle-cans and spray cans, due to the very appealing visual appearance thereof, particularly compared to plastics or steels, the suitability thereof for recycling and the high corrosion resistance thereof.

All the aluminium alloys in question hereinafter are designated, unless specified otherwise, according to the designations defined by the "Aluminum Association" in the "Registration Record Series" published regularly by this association.

Beverage cans, also known by those skilled in the art as "cans" are usually manufactured by deep drawing-ironing using sheets of 3104 type alloy in the H19 metallurgic state.

The sheet undergoes a first operation for blanking and cupping; more specifically, during this step, the coil of sheet feeds a press, also known as a "cupper", which cuts disks known as blanks and performs a first deep drawing operation to produce "cups". This is the step primarily concerned by the invention.

The cups are then conveyed to a second press or "body-maker" where they undergo at least one second deep drawing operation and a plurality of successive ironing operations; these consist of passing the deep-drawn blank through ironing rings in order to elongate and thin the metal.

Cans wherein the walls are thinner than the base are thus progressively obtained. These cans are then processed in a machine communicating a rotary movement thereto while a shear cuts said cans at the desired height.

The cans are then washed in a plurality of cleaning and rinsing baths and dried. After coating, the beverage cans are then conveyed to a necking and flanging station also known as a "necker flanger" where the upper part of the preform undergoes a plurality of successive diameter necking operations and flanging for the subsequent fitting of the lid.

Bottle-cans and spray cans or aerosol cans, made of aluminium alloy, are conventionally manufactured by impact extrusion, using slugs obtained from wheel casting.

The first aluminium alloy bottle-cans, manufactured by deep drawing-ironing followed by necking, emerged in Japan in 1993 and in Europe in 1995.

This is indicated by the patent applications JP 7060386 by Toyo Rikagaku Kenkyusho dated 1993 and EP 0740971 by Hoogovens subject to a priority date of 1995.

However, these bottles do not have a one-piece structure. Indeed, the vertical walls and neck of the bottle are manufactured from the base of the preform and a lid is crimped on the top of the preform.

This is also the case of the application WO 0115829, by Daiwa Can in 2000 subject to a priority date of 1999, claiming an aluminium alloy bottle manufactured by hot forming with a complex tool.

The manufacture of beverage cans, bottle cans or spray cans made of aluminium alloy essentially by means of deep drawing-ironing and necking indeed requires a material particularly capable of:

- undergoing deep drawing operations, i.e. the formation of cups with vertical walls and a horizontal base, with deep drawing ratios, i.e. the ratio of the blank diameter to the punch diameter, of up to 1.9 or more, with high necking deformations, in order to obtain a significant reduction in diameter in only two deep drawing passes (deep drawing and reworking deep drawing),
- and above all, according to this invention, providing high-quality cups, i.e. not having any defects known to those skilled in the art as "earing" or folds, so as to prevent any breakage during the subsequent ironing.

The first aluminium alloy bottle-cans, having a one-piece structure, and essentially manufactured by means of deep drawing-ironing followed by necking, emerged in Japan in the 2000s. This is indicated by the application JP 2003082429 by Kobe Steel subject to a priority date of 2001.

The same applies for the application EP 1870481 subject to a priority date of 2005 also by Kobe Steel.

This type of solution is also used in mass production particularly in the United States. However, it has the drawback of non-optimal malleability with respect to deep drawing and also with respect to necking.

In particular, after deep drawing the cups, from circular blanks, the shape of the developed perimeter, known to those skilled in the art as "earing", is not advantageous.

Indeed, it consists of a profile with six ears, including two positioned respectively at 0 and 180° from the rolling direction and 45° on either side of said direction, in accordance with FIG. 1.

It is found that such a configuration, due to the ears at 0 and 180°, has a serious risk of giving rise to the so-called "earing" phenomenon well known to those skilled in the art, with the risk of breakage during subsequent ironing operations.

To remedy this problem, the design and use in production of non-circular blanks for the manufacture of beverage cans are part of the prior art. In this context, the aim is to compensate for the earing properties of the metal by varying the blank diameter according to the orientation thereof with respect to the rolling direction. This technology is advantageous as it increases the ratio between the quantity of metal actually used in the beverage can and the quantity of metal involved on the flat metal, or strip.

Such a typical design is described perfectly particularly in the article "Convolute Cut-Edge Design for an Earless Cup in Cup Drawing" by R. E. Dick, J. W. Yoon and F. Barlat, CP778 Volume A, *Numishet* 2005.

Stated Problem

The use of this type of non-circular blank has unfortunately the major drawback of rendering the deep drawing process much more sensitive to the slightest variability in the metal earing properties. Indeed, the deep-drawn cup, produced from a non-circular blank, theoretically has a "flat" profile since the hollows and bumps have been compensated for by the variations in diameter of the initial blank. In this case, any variation in the metal ear properties will inevitably give rise to a profile having ears of uncontrolled size and orientation. In this way, a modification of the metal earing properties along the rolling axis or orthogonally to this axis, will favour the appearance of 2 diametrically opposed ears, which is conducive to the "earing" phenomenon that those skilled in the art seek to avoid at all costs.

In this way, the cup profile still has hollows and ears at the expense of the ratio between the quantity of metal actually used in the beverage can and the initial quantity of metal on the flat metal.

The aim of the invention is that of resolving these problems by proposing a non-circular blank removing any risk of earing when deep-drawing cups.

SUMMARY

The invention relates to a method for manufacturing a beverage can, a bottle or a spray can made of aluminium alloy, by means of deep drawing-ironing followed by necking and/or bending, from a non-circular blank, whereby:

The metal strip from which each blank is taken is virtually divided into identical regular hexagons wherein two opposite sides are substantially perpendicular to the rolling direction of said strip and forming a plane compact hexagonal system, The perimeter of said blank is calculated by adjustment using a concentric circle having a radius less than that of the inscribed circle of the corresponding hexagon, to compensate, during deep drawing, for the earing properties of the metal, according to a method known to those skilled in the art, typically as described in the article "Convolute Cut-Edge Design for an Earless Cup in Cup Drawing" by R. E. Dick, J. W. Yoon and F. Barlat, CP778 Volume A, *Numishet* 2005 and characterised in that

At least four ears are added beyond and from said perimeter, in the zones of the hexagon left free, either wherein the primary axis forms an angle respectively of substantially 35°, 145°, 215° and 325° with the rolling direction, each having a relative height of 0.3 to 0.8% with respect to said initial concentric circle, and a maximum width in view of the space available, or typically corresponding, at the mid-height of said ear, to a minimum angular sector of substantially 25° having the centre of the blank as the vertex thereof.

The invention also relates to a deep drawing blank of a beverage can, bottle-can or spray can, manufactured by means of a method as described above.

It also relates to a beverage can or bottle-can, also known to those skilled in the art as a "can" and "bottle type beverage can" respectively, manufactured from a blank having the above-mentioned features, including a bottle-can described as shaped, i.e. wherein the main walls are not strictly cylindrical.

It also relates to a spray can, also known to those skilled in the art as an "aerosol can" or "aerosol dispenser", manufactured from said blank having the above-mentioned features, including a spray can described as shaped, i.e. wherein the main walls are not strictly cylindrical.

This profile, with ears particularly for α=0 and 180°, corresponds to a cup according to the prior art without optimisation. Indeed, it consists of a profile with six ears, including two positioned respectively at 0 and 180° from the rolling direction and four at 45° on either side of said direction.

Figure 1:
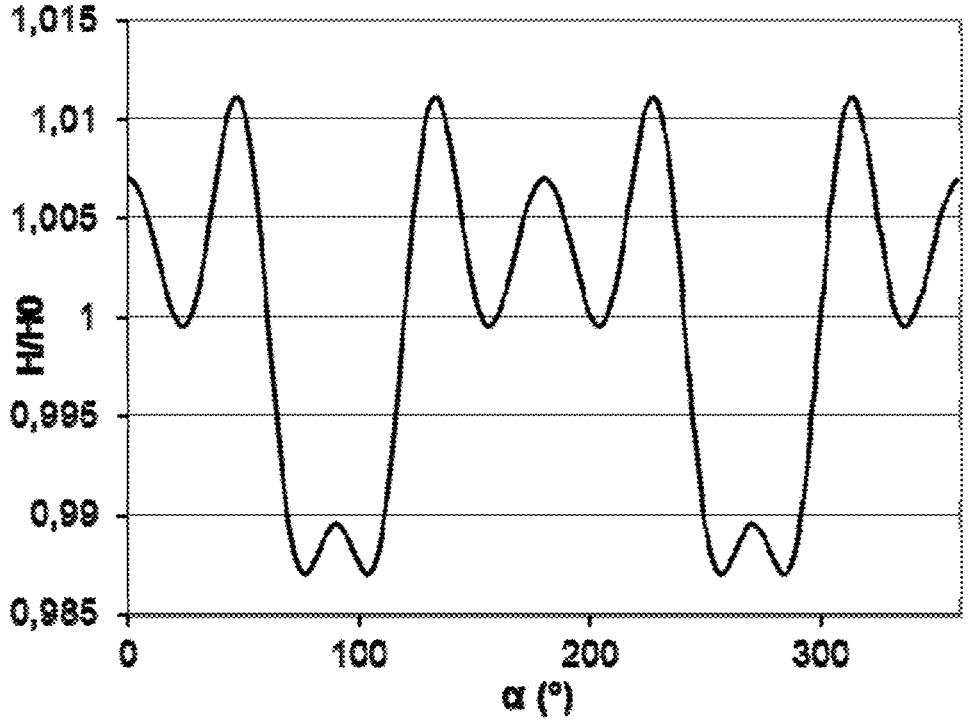
FIG. 1 Prior art
FIG. 1 represents the "ear profile", i.e. the shape of the developed perimeter of the vertex of the "cups" following the first deep drawing operation, with, on the y-axis, the ratio of the ear height to the mean cup height and, on the x-axis, the angle α with respect to the rolling direction.
Figure 2:
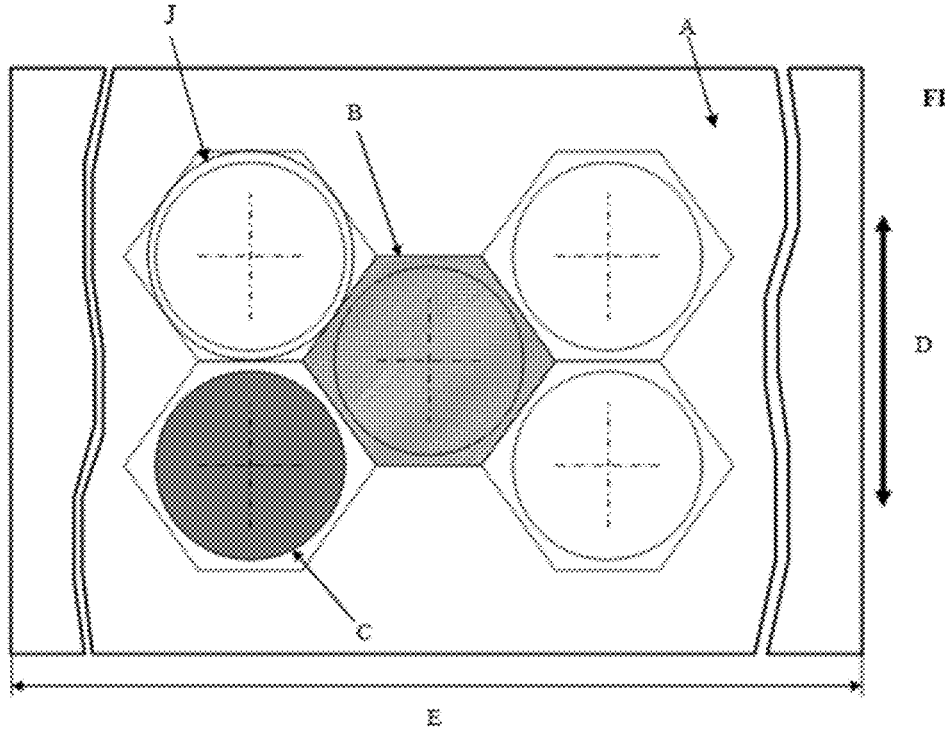

FIG. 2 represents the initial metal strip A and the virtual cutting thereof into regular hexagons B from which the blanks C, which has a radius less than the inscribed circle J, are taken. The rolling direction bears the reference D whereas the strip width bears the reference E.

Figure 3:
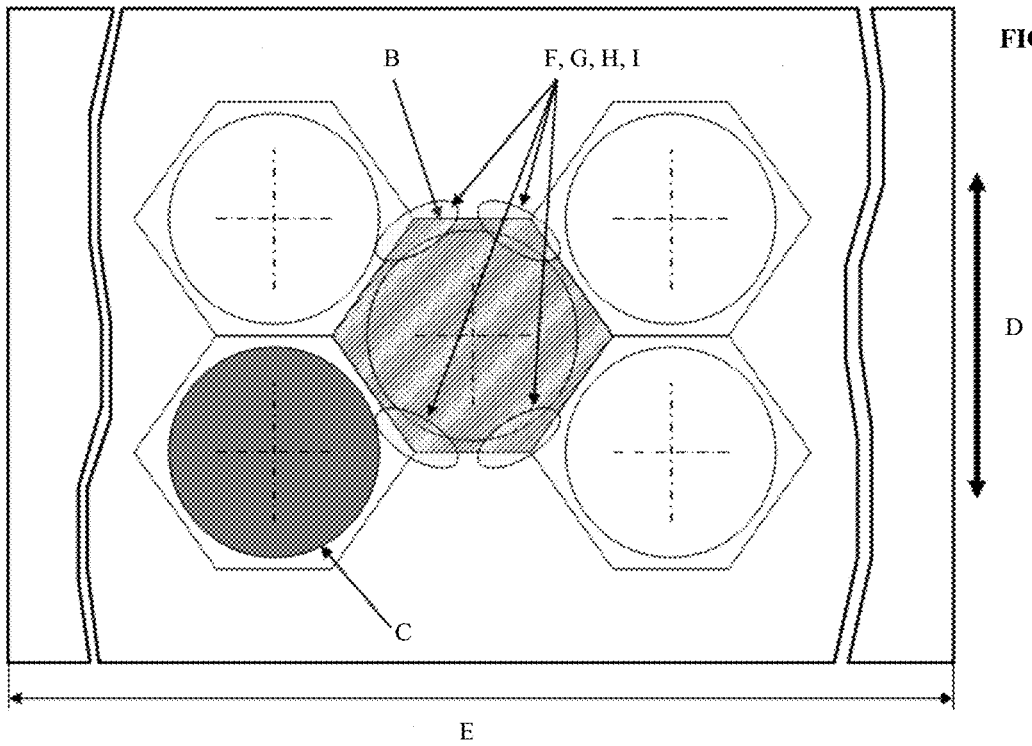

FIG. 3 provides the same indications, with, additionally, the zones of the hexagon left free in F, G, H and I.

Figure 4:
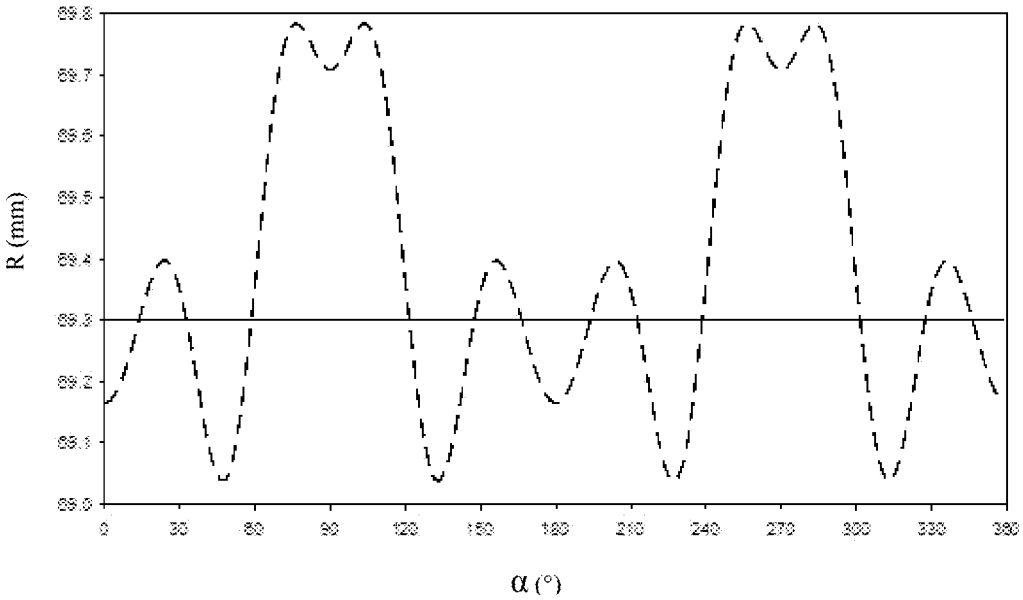
FIG. 4 Prior art

FIG. 4 represents a curve of the external flat profile of the uniform circular blank having a radius of 69.3 mm (solid line) and optimised non-circular blank to account for the earing properties of the metal according to the prior art (dotted-line curve). On the y-axis, the radius R in mm and, on the x-axis, the angle α formed with the rolling direction.

Figure 5:
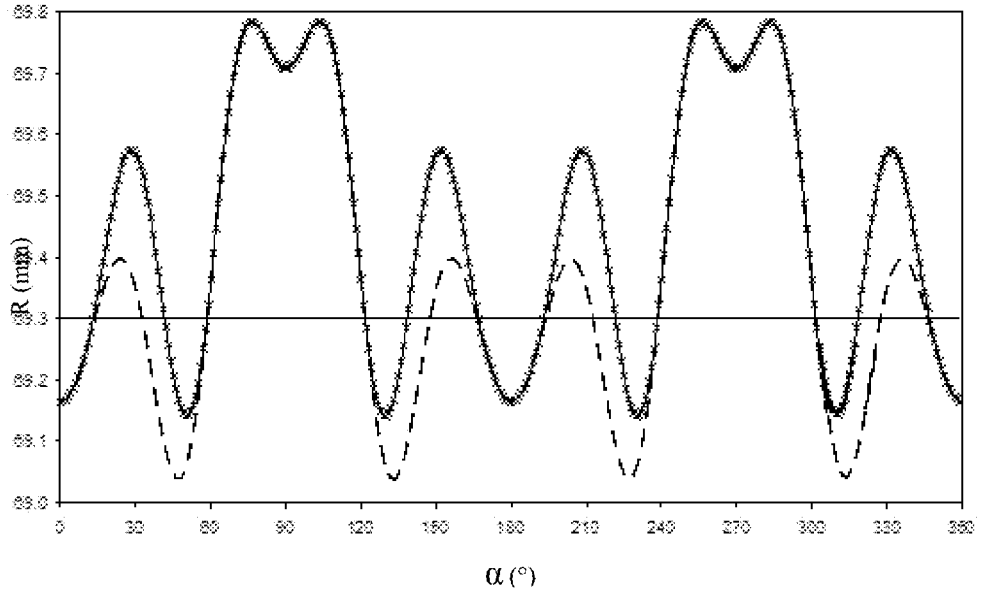

FIG. 5 represents a curve (continuous with additional X patterns) of the external flat profile of the non-circular blank according to the invention, devised by adding to the variant above four ears having a relative height equal to 0.35% of the radius of said variant.

The variant having a constant radius is still represented therein with a solid line and the so-called optimal blank according to the prior art with dotted lines as in FIG. 4.

Figure 6:
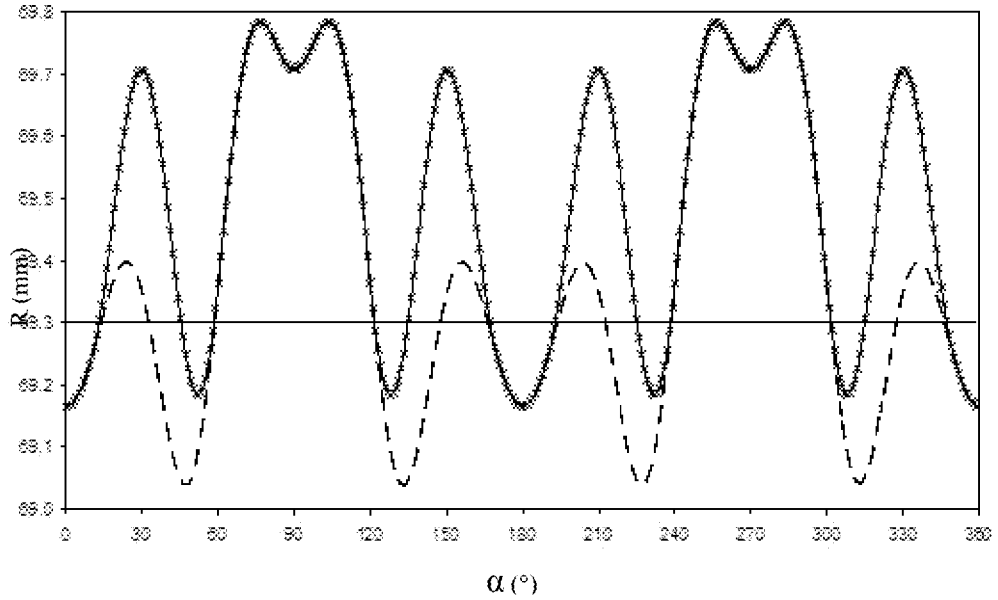

FIG. 6 represents a curve (continuous with additional X patterns) of the external flat profile of the non-circular blank according to the invention, devised by adding to the "optimised" variant in FIG. 4, four ears having a relative height equal to 0.57% of the radius of said variant.

The variant having a constant radius is still represented therein with a solid line and the so-called optimal blank variants according to the prior art with dotted lines as in FIG. 5.

Figure 7:
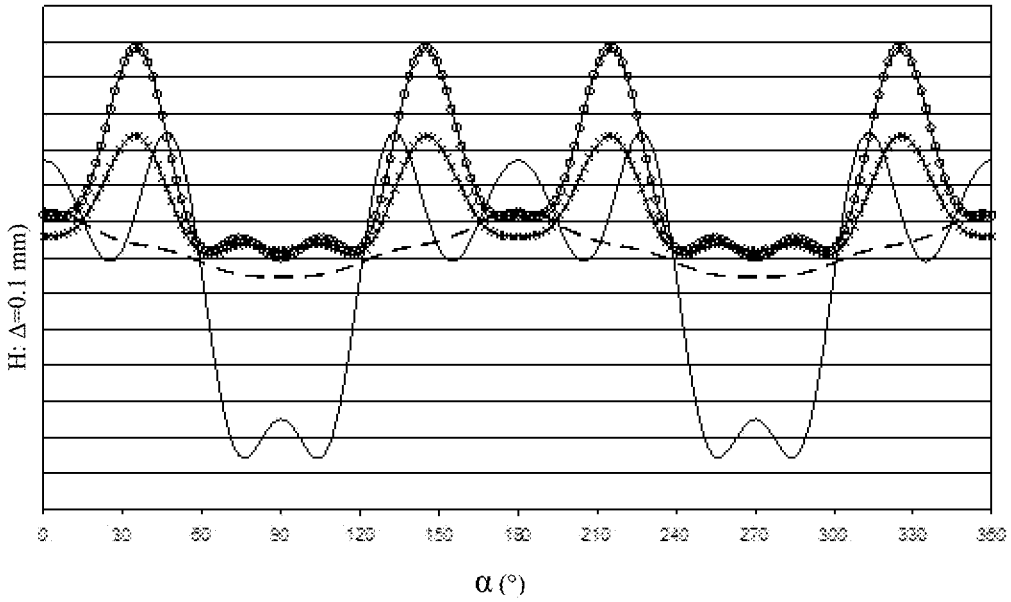

FIG. 7 represents the profile curves of the cups obtained from the 4 alternative blanks, with, on the y-axis, the cup height H at the corresponding point with an interval of 0.1 mm and on the x-axis the angle α formed with the rolling direction:

The solid-line curve represents the profile of the cups obtained with a uniform circular blank having a radius equal to 69.3 mm, The dotted-line curve represents the profile of the cups with a so-called "optimal" non-circular blank according to the prior art, The curve with X patterns represents the profile of the cups with an optimised non-circular blank according to the invention with 4 ears at 0.35%, The curve with dots represents the profile of the cups from an optimised non-circular blank according to the invention with 4 ears at 0.57%.

DETAILED DESCRIPTION OF A PREFERRED EMBODIMENT

The invention consists of a judicious choice of the design of the non-circular blank, optimised in two steps:

A first step for compensating for the earing properties according to the prior art: It consists of compensating for the effect of the earing properties of the metal by varying the blank diameter according to the orientation thereof with respect to the rolling direction, typically, and schematically, by increasing the radius of the blank along the directions corresponding to hollows on the cup profile, due to the earing properties of the metal during the first deep drawing step, and reducing same along the directions corresponding to ears or bumps on said profile.

Such a typical design is described perfectly particularly in the article "Convolute Cut-Edge Design for an Earless Cup in Cup Drawing" by R. E. Dick, J. W. Yoon and F. Barlat, CP778 Volume A, *Numishet* 2005.

A second step during which at least four ears beyond and from said perimeter are added, by increasing the radius of the blank in the zones beyond the blanks with no additional ears and inside the corresponding hexagon, along four symmetrical directions with respect to the rolling direction, as indicated in FIG. 3 (zones F, G, H and I).

More specifically, if the metal strips from which each blank is taken is split virtually into two identical regular hexagons wherein two opposite sides are substantially perpendicular to the rolling direction, thus forming a plane compact hexagonal system, as shown in FIG. 2, the four ears are added beyond and from said perimeter, in the zones of the hexagon left free, either wherein the primary axis forms an angle respectively of substantially 35°, 145°, 215° and 325° with the rolling direction, as shown in FIG. 3, each having a relative height of 0.3 to 0.8% with respect to said initial concentric circle, and a maximum width in view of the space available, or typically corresponding, at the mid-height of said ear, to a minimum angular sector of substantially 25° having the centre of the blank as the vertex thereof.

More specifically, the typical width at mid-height is equal to the length of the segment perpendicular to the radius joining the centre of the blank and the vertex of the ear, and defined by the intersection of the ear with a sector having an angle of substantially 30° from the centre of the blank.

The applicant observed that this optimisation had a very repetitive effect of minimising the risk of defects known to those skilled in the art as "earing" and folds, in order to prevent any breakage during subsequent ironing.

In the details thereof, the invention will be understood more clearly using the examples hereinafter, which are however not limiting in nature.

Examples

A type 3104 alloy ingot was cast by vertical continuous casting.

It was scalped and then homogenised at a temperature of approximately 580° C. for approximately 3 hours before undergoing hot rolling followed by cold rolling up to the final thickness of 0.264 mm i.e. the H19 metallurgic state.

"Cups" were produced from this sheet with a cup deep drawing punch diameter of 88.9 mm using blanks having a plate profile according to the variants hereinafter, all cut by laser:

Non-Inventive Variants 1 and 2

Variant 1 corresponds to a constant blank radius of 69.3 mm as represented with a solid line in FIG. 4, i.e. a circular blank without any optimisation.

Variant 2 corresponds to a so-called "optimal" blank, i.e. compensating "perfectly" for the earing properties of the metal, according to a method known to those skilled in the art, such as that mentioned above reported in the article "Convolute Cut-Edge Design for an Earless Cup in Cup Drawing" by R. E. Dick, J. W. Yoon and F. Barlat, CP778 Volume A, *Numishet* 2005.

It is represented in said FIG. 4 by a dotted-line curve.

Variant 3 According to the Invention

Variant 3 corresponds to a blank according to the invention, designed by adding to variant 2 above four ears at 35°, 145°, 215° and 325°, having a relative height equal to 0.35% of the radius of said variant 2 and a mid-height width corresponding to a sector of 30°.

It is represented in FIG. 5 by a continuous-line curve with added X patterns.

Variant 1 is still represented therein with a solid line and the so-called optimal blank according to the prior art with dotted lines as in FIG. 4.

Variant 4 According to the Invention

Variant 4 corresponds to a blank according to the invention, designed by adding to variant 2 above four ears at 35°, 145°, 215° and 325°, having a relative height equal to 0.57% of the radius of said variant 2 and a mid-height width corresponding to a sector of 30°.

It is represented in FIG. 6 by a continuous-line curve with added X patterns. Variant 1 is still represented therein with a solid line and the so-called optimal blank according to the prior art with dotted lines as in FIG. 4.

Results:

Using these four blank variants, we produced cups by deep drawing with a deep drawing punch diameter of 88.9 mm for a mean cup height of 32 mm.

FIG. 7 shows the profile curves of the cups obtained using the 4 blank variants:

The solid-line curve represents the profile of the cups obtained with a uniform circular blank having a radius equal to 69.3 mm.

The dotted-line curve represents the profile of the cups with a so-called "optimal" non-circular blank according to the prior art.

The curve with X patterns represents the profile of the cups with an optimised non-circular blank according to the invention with 4 ears at 0.35% according to variant 3. The curve with dots represents the profile of the cups from an optimised non-circular blank according to the invention with 4 ears at 0.57% according to variant 4.

It is clearly seen therein that the so-called "optimal" blank according to the prior art (dotted-line curve) compensates for the earing properties of the metal since the amplitude of the profile curve falls from 0.9 mm approximately to less than 0.2 mm. On the basis of the optimised profiles according to the invention, the 4 additional ears are clearly visible on the profile curves with X patterns and with dots. The difference in height of the additional ears is correctly correlated with the difference in height of the initial ears.

It is also observed that the height of the artificial ears, in the case of the ear profile at 0.57% (curve with dots), largely exceeds the height of the ears associated with the earing properties (solid-line curve) and joins same also in the case of the ears at 0.35% (curve with X pattern). In this way, the risk of seeing the emergence of a 2-ear system, which is more susceptible to the "earing" phenomenon, is clearly reduced, including with respect to case corresponding to the dotted curve of the optimisation according to the prior art, but also, negative values (hollows of upper cup profile) are not recorded.

The invention claimed is:

1. A method of manufacturing a non-circular blank for manufacturing a beverage can, a bottle-can, or a spray can made of an aluminium alloy, comprising:

(a) defining a final perimeter of said non-circular blank by:

dividing a metal strip from which said blank is taken into identical regular hexagons wherein two opposite sides of said hexagons are substantially perpendicular to a rolling direction of said strip and forming a planar hexagonal system wherein at least one side of each hexagon is common with a side of another hexagon, determining an initial perimeter of said blank by:

providing a concentric circle having a radius less than that of an inscribed circle of a corresponding hexagon, and adjusting the perimeter of the concentric circle to compensate for earing of the aluminium alloy developed during deep drawing by varying a diameter of the blank according to an orientation of the blank with respect to the rolling direction by:

increasing a radius of the blank at positions where hollows are predicted to develop relative to the rolling direction during the deep drawing process and decreasing the radius of the blank along directions corresponding to ears or bumps predicted to develop relative to the rolling direction during the deep drawing process, adding at least four ears beyond that of said initial perimeter, in zones of the virtual hexagon, wherein each of the ears is formed in the zones at angles of substantially 35°, 145°, 215° and 325°, respectively, with respect to the rolling direction, each ear having a relative height of 0.3 to 0.8% with respect to the radius of said concentric circle, and (b) cutting the blank along the final perimeter.

2. A non-circular blank for manufacturing a beverage can, bottle-can or spray can, manufactured by the method according to claim 1.

3. The method according to claim 1, wherein each ear has a maximum width in view of a space available in the zones of the virtual hexagon, corresponding, at mid-height of said ears, to a minimum angular sector of substantially 25°, having the centre of the blank as a vertex thereof.

4. A beverage can, bottle-can or spray can manufactured by deep drawing-ironing followed by necking and/or bending of the blank according to claim 2.

5. The method according to claim 1, wherein each ear has a maximum width in view of a space available in the zones of the virtual hexagon, corresponding, at mid-height of said ears, to a minimum angular sector of substantially 30°, having the centre of the blank as a vertex thereof.

6. The method according to claim 1, wherein each ear has a relative height of 0.35 to 0.8% with respect to the radius of said concentric circle.

7. The method according to claim 1, wherein each ear has a relative height of 0.57 to 0.8% with respect to the radius of said concentric circle.

8. The method of claim 1, wherein said aluminum alloy comprises a type 3104 alloy.

9. A method of manufacturing a beverage can, a bottle, or a spray can made of aluminum alloy comprising:

manufacturing the non-circular blank according to claim 1, deep drawing-ironing of the non-circular blank to produce a cup, followed by necking and/or bending the cup to form the beverage can, bottle, or spray can.

10. The method according to claim 1, wherein none of the ears added are along the rolling axis and/or orthogonally to the rolling axis, at angles substantially 0°, 90°, 180° or 270° with the rolling axis.

11. The method according to claim 1, wherein 4 ears are added beyond that of said initial perimeter.

* * * * *